US008414422B2

(12) United States Patent
Peralta et al.

(10) Patent No.: US 8,414,422 B2
(45) **Date of Patent: *Apr. 9, 2013**

(54) EXTERNAL WEIGHT FOR GOLF CLUB HEAD

(75) Inventors: Martin Peralta, Oceanside, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 371 days.

This patent is subject to a terminal disclaimer.

(21) Appl. No.: 12/940,371

(22) Filed: Nov. 5, 2010

(65) Prior Publication Data

US 2011/0143858 A1 Jun. 16, 2011

Related U.S. Application Data

(60) Provisional application No. 61/286,971, filed on Dec. 16, 2009.

(51) Int. Cl.
*A63B 53/04* (2006.01)

(52) U.S. Cl. ..... 473/334; 473/335; 473/338; 473/345; 473/349

(58) Field of Classification Search ..... 473/324–350, 473/287–292, 256
See application file for complete search history.

(56) References Cited

U.S. PATENT DOCUMENTS

| | | | | |
|---|---|---|---|---|
| 1,167,387 | A | | 1/1916 | Daniel |
| 1,780,625 | A | | 4/1924 | Mattern |
| 1,568,888 | A | | 1/1926 | Dunn |
| 1,638,916 | A | | 6/1926 | Butchart |
| 2,336,405 | A | | 12/1943 | Kent |
| 2,750,194 | A | | 1/1955 | Clark |
| D179,002 | S | | 10/1956 | Hoffmeister |
| 3,397,888 | A | | 8/1968 | Springer et al. |
| 3,486,755 | A | | 12/1969 | Hodge |
| 3,606,327 | A | * | 9/1971 | Gorman ..... 473/297 |
| 3,692,306 | A | | 9/1972 | Glover |
| D226,431 | S | | 3/1973 | Baker |
| D229,431 | S | | 11/1973 | Bkaer |
| 3,863,932 | A | | 2/1975 | Lezatte |
| 3,897,066 | A | | 7/1975 | Belmont |
| 3,901,514 | A | | 8/1975 | Priaulx |
| 3,937,474 | A | | 2/1976 | Jepson et al. |
| 3,941,390 | A | | 3/1976 | Hussey |
| 3,955,820 | A | | 5/1976 | Cochran |
| 3,966,210 | A | | 6/1976 | Rozmus |
| 3,975,023 | A | | 8/1976 | Inamori |
| 3,981,507 | A | | 9/1976 | Nunziato |
| 3,989,248 | A | | 11/1976 | Campau |
| 4,010,958 | A | | 3/1977 | Long |
| 4,021,047 | A | | 5/1977 | Mader |
| 4,195,842 | A | * | 4/1980 | Coleman ..... 473/337 |
| D268,357 | S | | 3/1983 | Mader |
| 4,398,965 | A | | 8/1983 | Campau |

(Continued)

*Primary Examiner* — Sebastiano Passaniti
(74) *Attorney, Agent, or Firm* — Michael A. Catania; Rebecca Hanovice; Sonia Lari

(57) ABSTRACT

The present invention relates to a golf club head with external weights that allows for weight modification after the manufacturing process. The golf club head comprises a face component and an aft-body. A plurality of recessed cavities are located on the aft-body. A weight component is disposed within the recessed cavities. A timesert is located at the bottom center of each of the recessed cavities. The timesert is comolded to the aft-body. The weight component is fastened to the timesert by use of a bolt. The recessed cavities are preferably circular in shape.

20 Claims, 4 Drawing Sheets

U.S. PATENT DOCUMENTS

| | | | | |
|---|---|---|---|---|
| 4,568,088 | A | 2/1986 | Kurahashi | |
| 4,872,685 | A | 10/1989 | Sun | |
| 4,877,249 | A | 10/1989 | Thompson | |
| 5,106,094 | A | 4/1992 | Desboilles et al. | |
| 5,154,425 | A | 10/1992 | Niskanen | |
| 5,193,811 | A | 3/1993 | Okumoto | |
| 5,282,624 | A | 2/1994 | Viste | |
| 5,310,185 | A | 5/1994 | Viollaz et al. | |
| 5,344,140 | A | 9/1994 | Anderson | |
| 5,346,216 | A | 9/1994 | Aizawa | |
| 5,346,217 | A | 9/1994 | Tsuchiya et al. | |
| 5,377,986 | A | 1/1995 | Viollaz et al. | |
| 5,398,935 | A | 3/1995 | Katayama | |
| 5,410,798 | A | 5/1995 | Lo | |
| 5,421,577 | A | 6/1995 | Kobayashi | |
| 5,425,538 | A | 6/1995 | Vincent et al. | |
| 5,431,401 | A | 7/1995 | Smith | |
| 5,464,210 | A | 11/1995 | Davis et al. | |
| 5,474,296 | A | 12/1995 | Schmidt et al. | |
| 5,499,814 | A | 3/1996 | Lu | |
| 5,516,107 | A | 5/1996 | Okumoto et al. | |
| 5,547,427 | A | 8/1996 | Rigal et al. | |
| 5,570,886 | A | 11/1996 | Rigal et al. | |
| 5,624,331 | A | 4/1997 | Lo et al. | |
| 5,743,813 | A | 4/1998 | Chen et al. | |
| 5,776,011 | A | 7/1998 | Su et al. | |
| 5,830,084 | A | 11/1998 | Kosmatka | |
| 5,836,830 | A | 11/1998 | Onuki et al. | |
| 5,863,261 | A | 1/1999 | Eggiman | |
| 5,888,148 | A | 3/1999 | Allen | |
| 5,947,838 | A | 9/1999 | Tkacs | |
| D415,807 | S | 10/1999 | Werner | |
| 5,985,197 | A | 11/1999 | Nelson et al. | |
| 6,012,989 | A | 1/2000 | Saksun | |
| 6,048,278 | A | 4/2000 | Meyer et al. | |
| 6,146,571 | A | 11/2000 | Vincent et al. | |
| 6,149,534 | A | 11/2000 | Peters et al. | |
| 6,152,833 | A | 11/2000 | Werner et al. | |
| 6,165,081 | A | 12/2000 | Chou | |
| 6,310,185 | B1 | 10/2001 | Wallace et al. | |
| 6,332,848 | B1 | 12/2001 | Long et al. | |
| 6,334,817 | B1 | 1/2002 | Ezawa et al. | |
| 6,348,015 | B1 | 2/2002 | Kosmatka | |
| 6,354,962 | B1 | 3/2002 | Galloway et al. | |
| 6,390,933 | B1 | 5/2002 | Galloway et al. | |
| 6,406,381 | B2 | 6/2002 | Murphy et al. | |
| 6,478,692 | B2 | 11/2002 | Kosmatka | |
| 6,488,594 | B1 | 12/2002 | Card et al. | |
| 6,602,149 | B1 | 8/2003 | Jacobson | |
| 6,648,773 | B1 | 11/2003 | Evans | |
| D489,105 | S | 4/2004 | Kim | |
| D524,890 | S | 7/2006 | Foster et al. | |
| 7,153,220 | B2 * | 12/2006 | Lo | 473/335 |
| 7,559,851 | B2 | 7/2009 | Cackett et al. | |
| 7,771,290 | B2 * | 8/2010 | Bezilla et al. | 473/335 |
| 8,197,357 | B1 * | 6/2012 | Rice et al. | 473/334 |
| 8,197,358 | B1 * | 6/2012 | Watson et al. | 473/334 |
| 8,202,175 | B2 * | 6/2012 | Ban | 473/338 |
| 8,235,843 | B1 * | 8/2012 | Rice et al. | 473/334 |
| 8,257,196 | B1 * | 9/2012 | Abbott et al. | 473/335 |
| 8,262,506 | B2 * | 9/2012 | Watson et al. | 473/334 |
| 2006/0089206 | A1 * | 4/2006 | Lo | 473/334 |
| 2007/0015600 | A1 * | 1/2007 | Breier et al. | 473/334 |

* cited by examiner

EXTERNAL WEIGHT FOR GOLF CLUB HEAD

CROSS REFERENCES TO RELATED APPLICATIONS

The Present Application claims priority to U.S. Provisional Patent Application No. 61/286971, filed on Dec. 16, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to the manufacture of golf club heads. Particularly to the manufacture of a golf club head with an improved center of gravity and moment of inertia.

2. Description of the Related Art

As driver golf club heads have increased in volume (>300 cubic centimeters) their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the aforementioned deleterious effects, which are accentuated for larger faces. The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

Currently, golf club heads made of metal, composite, or other material are produced with a specific weight which is fixed once the golf club head is finished. The fixed weight of the golf club head determines the center of gravity and moment of inertia. After the golf club head is finished, there exists a small amount of weight which needs to be adjusted. This small amount of weight is called the swing weight. Presently, if the swing weight needs to be adjusted, to alter the center of gravity and/or moment of inertia, the fixed weight must be changed, which requires the manufacture of a new golf club head.

One invention that addresses a golf club head with an improved moment of inertia and center of gravity is U.S. Pat. No. 7,559,851 issued to Cackett et al. for Golf Club Head with High Moment of Inertia. This patent discloses a golf club head with a moment of inertia, Izz, about the center of gravity of the golf club head that exceeds 5000 grams-centimeters squared Another example is U.S. Pat. No. 3,897,066 to Belmont which discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

Yet another example is U.S. Pat. No. 2,750,194 to Clark which discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

It is the object of this invention to adjust the swing weight of the golf club head externally, without having to manufacture a new golf club head. The golfer will be able to adjust the center of gravity and moment of inertia to best suit his or her playing needs. The golf club head has external weights positioned at specific locations on the golf club head body to improve the center of gravity and moment of inertia characteristics. The weights to be inserted into the cavities of the golf club head are all of the same size and shape, however vary in density. This allows for the weights to be interchangeable depending on the golfer's individual needs. The aft-body of the golf club head is preferably composed of a composite material with recessed cavities to engage the weights. In the center bottom of the recessed cavities, a timesert is comolded when the composite aft-body is manufactured. Once the composite material is cured, the timesert is permanently bonded to the golf club head body. A bolt is used to fasten the weight to the body. The walls of the recessed cavities have a 20 degree taper to engage the weight and produce a tight fit. The tapered walls are in contact with the weights and receive the force of impact when the golf club is used. A main feature of the present invention is the ability to externally adjust the weight of a golf club head having a composite aft-body. The ability to remove and reposition the weights to other locations on the body, after manufacture, is a novel feature.

BRIEF SUMMARY OF THE INVENTION

The present invention relates to a golf club head having optimized inertial properties a center of gravity.

The present invention comprises a golf club head which has a face component comprising a front wall and a return portion. The face component composed of a non-metallic material. The golf club head further comprises an aft body connected to the face component. The aft-body comprises a sole portion, a ribbon portion and a crown portion. The aft-body is composed of a non-metallic material.

A plurality of recessed cavities are located on the aft-body. A weight component is disposed within the recessed cavities. In a preferred embodiment, a weight is disposed in each recessed cavity. In an alternative embodiment, only those recessed cavities are engaged with a weight as required to effectively adjust the center of gravity and moment of inertia for the individual golfer. A timesert is located at the bottom center of each of the recessed cavities. The timesert is comolded to the aft-body. The weight component is fastened to the timesert by use of a bolt. The recessed cavities are preferably circular in shape.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
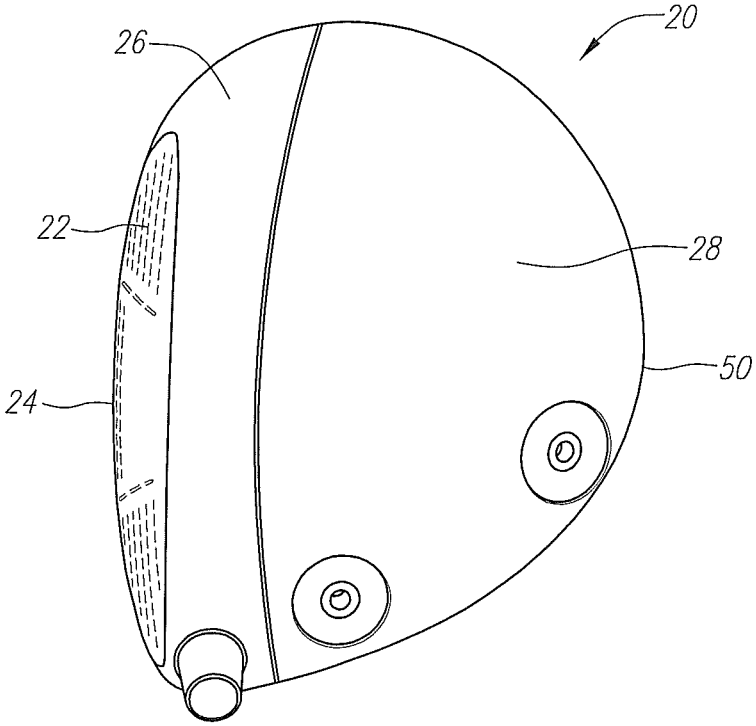
FIG. 1 is a top plan view of the present invention.
Figure 2:
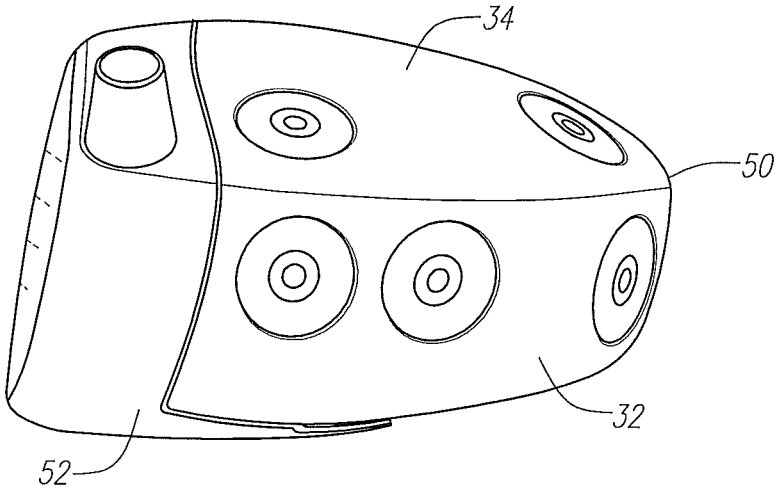
FIG. 2 is a heel view of the present invention.
Figure 3:
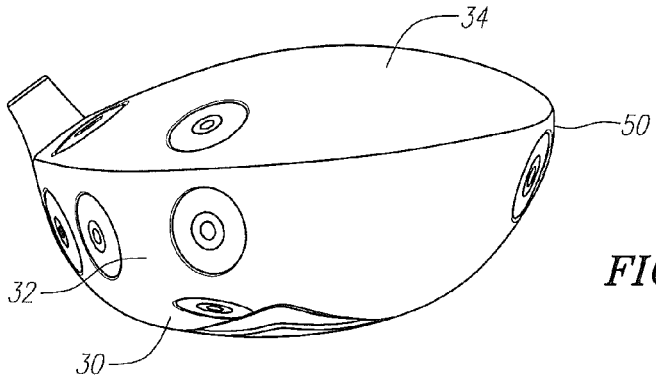
FIG. 3 is a perspective view of the present invention.
Figure 3A:
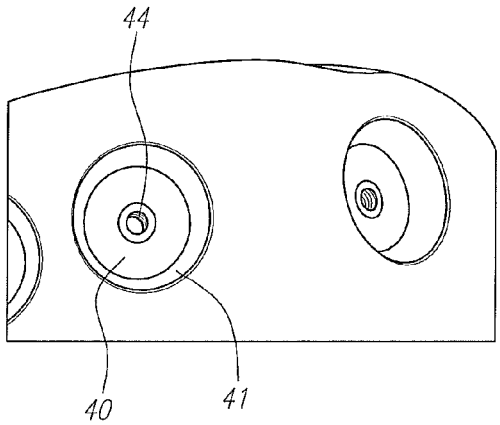
FIG. 3A is an exploded view of the FIG. 3.
Figure 4:
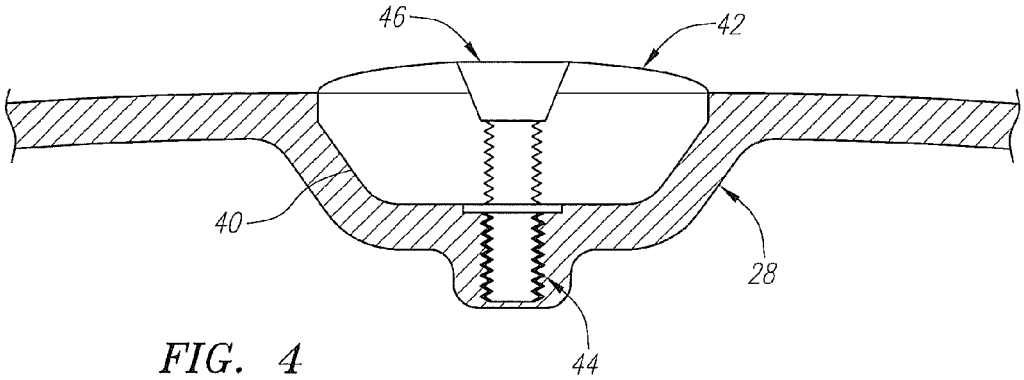
FIG. 4 is a cross-sectional view of the present invention.
Figure 5:
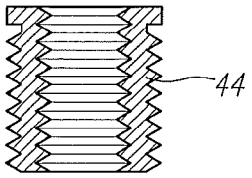
FIG. 5 is a view of the timesert of the present invention
Figure 5A:
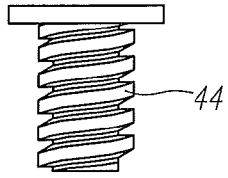
FIG. 5A is an alternative view of the timesert of the present invention.
Figure 6:
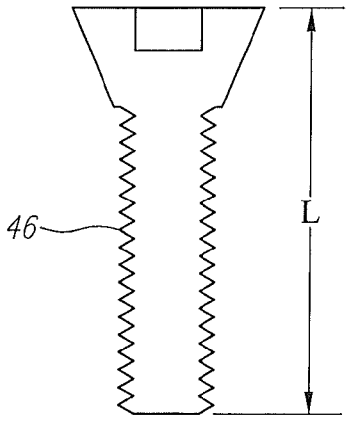
FIG. 6 is a view of the bolt of the present invention.
Figure 6A:
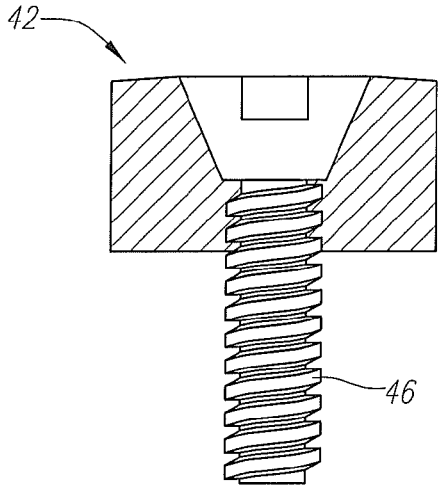
FIG. 6A is an alternative view of the bolt of the present invention.
Figure 7:
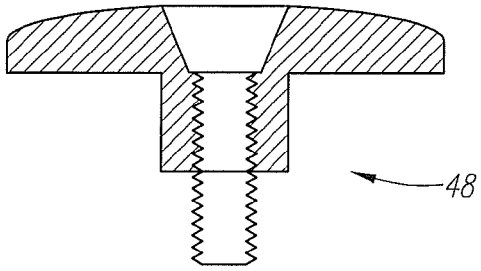
FIG. 7 is a view of a Derlin plug which may be used in the present invention.

As shown in FIGS. 1-9, the present invention comprises a golf club head 20 which has a face component 22 comprising a front wall 24 and a return portion 26. The face component 22 is composed of a non-metallic material. The golf club head 20 further comprises an aft body 28 connected to the face component 22. The aft-body 28 comprises a sole portion 30, a ribbon portion 32 and a crown portion 34. The aft-body 28 is composed of a non-metallic material. The golf club head 20 also has a back portion 50, a heel portion, 52 and a toe portion 54.

A plurality of recessed cavities 40 are located on the aft-body. A weight 42 is disposed within the recessed cavities 40. In a preferred embodiment, a weight 42 is disposed in each recessed cavity 40. In an alternative embodiment, only those recessed cavities 40 are engaged with a weight 42 as required to effectively adjust the center of gravity and moment of inertia for the individual golfer. The weight 42 preferably ranges in mass between 5 grams and 40 grams, more preferably between 10 grams and 30 grams, and most preferably 15 grams to 25 grams. More specifically, if the weight 42 is a toe weight 42, the toe weight 42 preferably ranges in mass between 5 grams and 25 grams, more preferably between 6 grams and 20 grams, and most preferably 6 grams to 16 grams. More specifically, if the weight 42 is a heel weight 42, the heel weight 42 preferably ranges in mass between 10 grams and 40 grams, more preferably between 10 grams and 30 grams, and most preferably 12 grams to 29 grams. More specifically, if the weight 42 is a back weight 42, the back weight 42 preferably ranges in mass between 10 grams and 40 grams, more preferably between 15 grams and 30 grams, and most preferably 23 grams.

A timesert 44 is located at the bottom center of each of the recessed cavities 40. The timesert 44 is comolded to the aft-body 28. The weight 42 is fastened to the timesert 44 by use of a bolt 46.

The plurality of recessed cavities 40 may be located on the sole portion 30, the crown portion 34, and/or the ribbon portion 32. The recessed cavities 40 are preferably circular in shape. The weights 42 are preferably composed of tungsten brass, titanium, aluminum, or stainless steel. The aft-body 28 is preferably composed of a composite material.

In a preferred embodiment, the timesert 44 is preferably a 6-32 metal timesert, which weighs approximately 0.3 grams and the bolt 46 is preferably a 6-32 metal bolt, which weighs approximately 0.93 grams. In an alternative embodiment, the timesert 44 is a 8-32 timesert 44, which weighs approximately 0.4 grams and the bolt 46 is a 8-32 bolt 46 which weighs approximately 1.4 grams. Alternatively, the timesert 44 is a 4-40 timesert 44, which weighs approximately 0.15 grams. Additionally, the bolt 46 may alternatively be a derlin plug with plastic screw 48, which weighs approximately 0.7 grams. The length (L) of the screw is approximately 0.500 inch.

Figure 8:
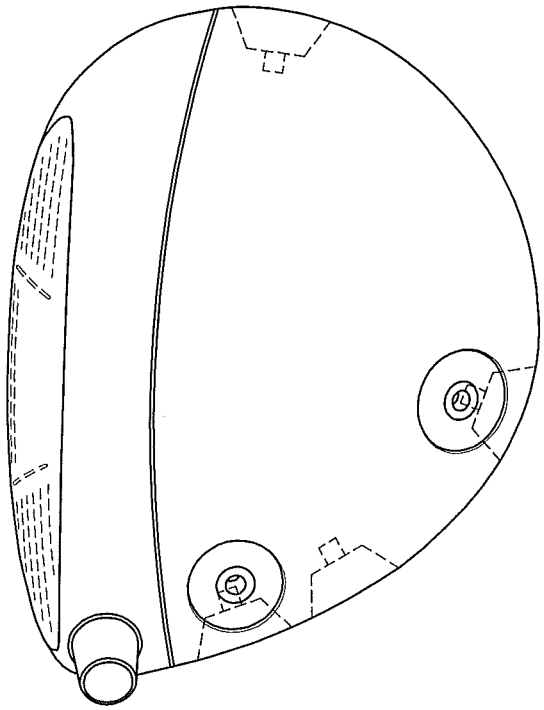
FIG. 8 is a top plan view of the present invention.
Figure 9:
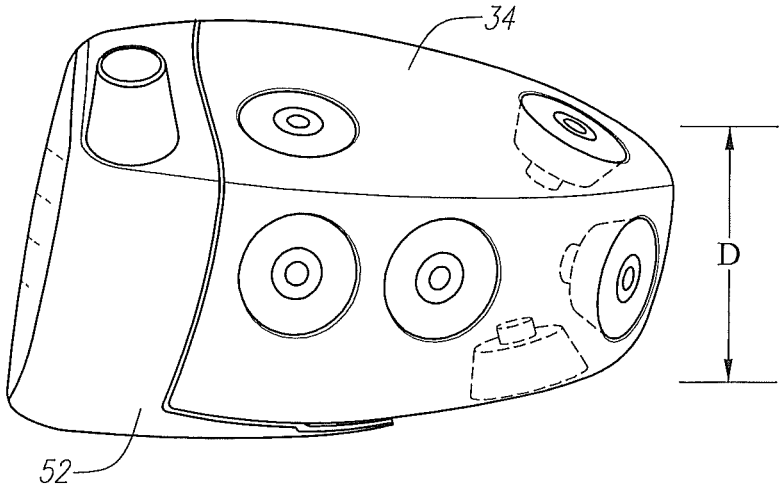
FIG. 9 is a side view of the present invention.

As shown in FIGS. 8-9, in one embodiment of the present invention, there exist two recessed cavities 40 on the crown portion 34, four recessed cavities 40 on the ribbon section 32 and one recessed cavity 40 on the sole 30. One of the recessed cavities 40 on the crown portion 34, one of the recessed cavities 40 on the ribbon portion 32 and the recessed cavity 40 on the sole portion 30 are located at the back 50 end of the golf club head 20 and are all in alignment. The distance, D, from the edge of the recessed cavity 40 on the crown portion 34 which is closest to the sole 30, to the edge of the recessed cavity 40 on the sole portion 30 which is closest to the crown 34, is approximately 1.25 inches. To achieve a fade, neutral, draw or maximum draw, the table below is a suggestion for weight placements in this embodiment.

TABLE ONE

| | Toe | Back | Heel |
|---|---|---|---|
| Fade | 16.4 grams | 23 grams | 12.6 grams |
| Neutral | 11.6 grams | 23 grams | 17.4 grams |
| Draw | 6 grams | 23 grams | 23 grams |
| Maximum Draw | 0 grams | 23 grams | 29 grams |

To achieve a different draw bias, approximately 5 grams of the weight 42 is shifted in the heel 52-toe 54 direction. For a high shot, a weight 42 of 23 grams should be placed in the cavity 40 located on the crown portion 34 at the back 50 of the golf club head 20. For a low shot, a weight of 23 grams should be placed in the cavity 40 located on the sole portion 30 at the back of the golf club head 20.

The wall 41 of the recessed cavity has a 20 degree taper which engages the weight 42 to form a tight fit. Each of the plurality of recessed cavities 40 has the same size and shape, so as to enable the ability to interchange the weights 42 of different densities. Each weight 42 is also of the same size and shape. There exists a plurality of weights 42 composed of various materials having differing densities.

Another aspect of the golf club head 20 of the present invention is directed a golf club head 20 that has a high coefficient of restitution for greater distance of a golf ball hit with the golf club head of the present invention. The coefficient of restitution (also referred to herein as "COR") is determined by the following equation:

$$e=v_2-v_1/U_1-U_2$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86.

As defined in *Golf Club Design, Fitting, Alteration & Repair*, 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention is preferably greater than 3000 g-cm$^2$, and more preferably greater than 3500 g-cm$^2$. The moment of inertia, Iyy, about the Y axis for the golf club head 20 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 20 of the present invention is preferably in the range from 1500 g-cm$^2$ to 3800 g-cm$^2$, more preferably from 1600 g-cm$^2$ to 3100 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a face component comprising a front wall and a return portion, the face component composed of a non-metallic material;

an aft body connected to the face component, the aft-body comprising a sole portion, a ribbon portion and a crown portion, the body composed of a non-metallic material;

a plurality of recessed cavities;

a weight component disposed within a recessed cavity, the recessed cavity located on the aft-body portion; and a timesert located at the bottom center of the recessed cavity, the timesert being comolded to the aft-body;

wherein the weight component being fastened to the timesert by use of a bolt.

2. The golf club head according to claim 1 wherein there are multiple cavities located on the sole portion.

3. The golf club head according to claim 1 wherein the aft-body is composed of a composite material.

4. The golf club head according to claim 1 wherein there are multiple cavities located on the crown portion.

5. The golf club head according to claim 1 wherein the cavity is circular in shape.

6. The golf club head according to claim 1 wherein the weight is composed of tungsten.

7. The golf club head according to claim 1 wherein the weight is composed of brass.

8. The golf club head according to claim 1 wherein the weight is composed of titanium.

9. The golf club head according to claim 1 where in the weight is composed of aluminum.

10. The golf club head according to claim 1 wherein the weight is composed of stainless steel.

11. A golf club head comprising:

a face component comprising a front wall and a return portion, the face component composed of a non-metallic material;

an aft body connected to the face component, the aft-body comprising a sole portion, a ribbon portion and a crown portion, the body composed of a non-metallic material;

a plurality of recessed cavities, the recessed cavities being circular in shape;

a weight component disposed within a recessed cavity, the recessed cavity located on the aft-body portion; and a timesert located at the bottom center of each recessed cavity, the timesert being comolded to the aft-body;

wherein the weight component being attached to the timesert by use of a bolt.

12. The golf club head according to claim 11 wherein the aft-body is composed of a composite material.

13. The golf club head according to claim 11 wherein the timesert is a 6-32 metal timesert and the bolt is a 6-32 metal bolt.

14. The golf club head according to claim 11 wherein the recessed cavity has a 20 degree taper.

15. The golf club head according to claim 11 wherein the weight is composed of tungsten.

16. The golf club head according to claim 11 wherein the weight is composed of brass.

17. The golf club head according to claim 11 wherein the weight is composed of titanium.

18. The golf club head according to claim 11 where in the weight is composed of aluminum

19. The golf club head according to claim 11 wherein the weight is composed of stainless steel.

20. The golf club head according to claim 11 wherein each of the plurality of recessed cavities is of the same size and shape.

* * * * *